United States Patent [19]

Moss et al.

[11] Patent Number: 4,483,035

[45] Date of Patent: Nov. 20, 1984

[54] WET MOP HOLDER

[75] Inventors: Theron C. Moss, Cleveland, Tenn.; Erwin Tomm, Cleveland, Ohio

[73] Assignee: Seco Industries, Inc., Cleveland, Tenn.

[21] Appl. No.: 483,385

[22] Filed: Apr. 8, 1983

[51] Int. Cl.[3] ..... A47L 13/24

[52] U.S. Cl. ..... 15/153; 15/228

[58] Field of Search ..... 15/228, 229 R, 229 A, 15/147 R, 150, 151, 153

[56] References Cited

U.S. PATENT DOCUMENTS 1,475,479 11/1923 Feth ..... 15/153

3,201,816 8/1965 Bryce ..... 15/151 X 3,544,173 12/1970 Senick et al. ..... 15/153 X 4,422,203 12/1983 Zenker ..... 15/150

*Primary Examiner*—Chris K. Moore

*Attorney, Agent, or Firm*—Maky, Renner, Otto & Boisselle

[57] ABSTRACT

Mop holder includes a main frame portion having a loading bar cantilevered at one end to the main frame portion and a hinged side gate at the other end which can be lifted up to permit a mop swab to be slid on or off the loading bar at such other end. A clamping bar movable toward and away from the loading bar releasably clamps the mop swab tightly against the loading bar.

10 Claims, 3 Drawing Figures

WET MOP HOLDER

BACKGROUND OF THE INVENTION

This invention relates generally as indicated to a wet mop holder which provides for ease of attachment of a mop swab to a handle and replacement thereof.

One common form of mop holder requires the mop swab to be threaded through an opening therein and then clamped in place. To remove the mop swab from the holder, the procedure is just reversed. Not only can this procedure sometimes be difficult depending on the relative size of the particular mop swab being used, but it requires handling of the mop swab, which may be especially objectionable during removal of the mop swab if it is heavily soiled.

There is another form of mop holder of this same general type but which has a hinged bottom bar that can be dropped down to permit the swab to be inserted in the holder and removed therefrom without having to thread the swab through an opening in the holder. Nevertheless, this particular type of holder still has the disadvantage that the swab must be manually held on the bar while the bar is raised back up and locked in place.

SUMMARY OF THE INVENTION

With the foregoing in mind, it is the principle object of this invention to provide a mop holder which greatly facilitates attachment of a mop swab to a mop handle and removal and/or replacement thereof.

Another object is to provide such a mop holder which eliminates the need for having to touch the swab during its removal from the holder.

Still another object is to provide such a mop holder in which a relatively wide range of sizes of mop swabs can readily by inserted and clamped in place and just as readily removed therefrom for laundering and/or replacement.

These and other objects of the present invention may be achieved by providing the mop holder with a main frame portion having a loading bar cantilevered at one end and a hinged side gate engageable with the other end. The side gate can be lifted up to permit a mop swab to be slid on or off the loading bar. Also, a clamping bar is desirably provided for clamping the swab tightly against the loading bar and releasing same. A hook may be provided on the free end of the loading bar for engagement with a rib on the side gate when the side gate is closed to support such free end when the swab is clamped against the loading bar and also provide a positive lock between the side gate and loading bar preventing opening of the side gate while such swab is thus clamped. Upon release of the clamping force, the side gate may readily be opened, at which time the swab is free to slide off the loading bar without having to touch the swab.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
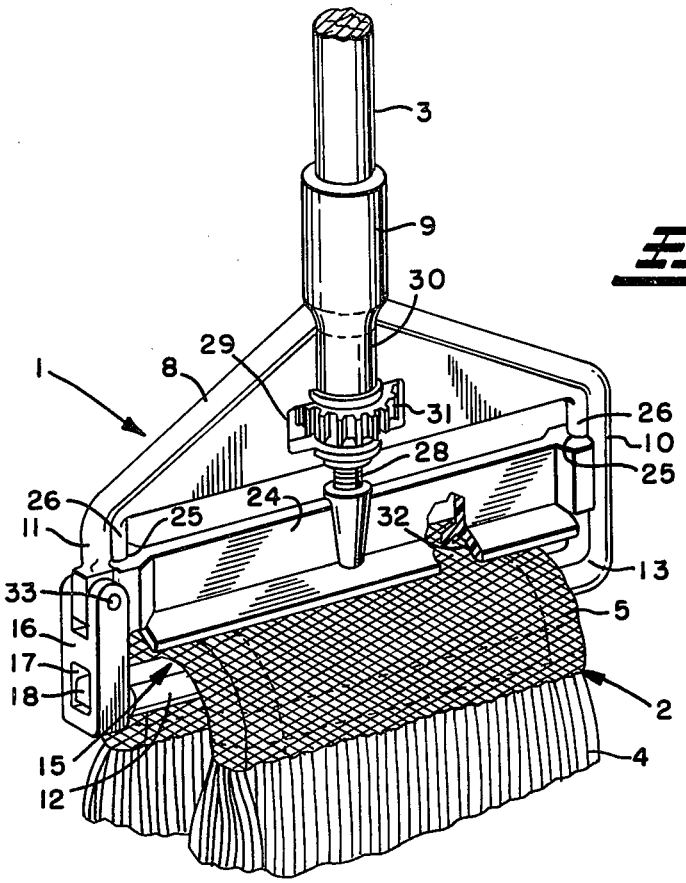
FIG. 1 is an isometric view of a preferred form of wet mop holder in accordance with this invention illustrating the manner in which the headband of a mop swab is clamped thereby.

Referring now in detail to the drawings, and initially to FIG. 1 thereof, a preferred form of wet mop holder 1 in accordance with this invention is shown for use in attaching a mop swab 2 to a mop handle 3. The mop swab may be of conventional type including a plurality of mop cords or yarns 4 secured together in bunched relationship intermediate their ends as by means of a band 5 of textile fabric or other suitable material wrapped around the bunched cords and secured thereto as by stitching through the headband and cords in conventional manner.

The mop holder 1 includes a main frame portion 8 which may, for example, have a socket 9 at one end for receipt of one end of the mop handle 3 and held in place by a suitable fastener or the like. The main frame portion has a pair of longitudinally extending side members 10 and 11 at opposite sides thereof. One of the side members 10 is substantially longer than the other side member 11 and has a loading bar 12 rigidly cantilevered at one end 13 to the outer end of the longer side member 10. The loading bar extends transversely across substantially the entire width of the main frame portion in spaced relation therefrom thus providing an open area 15 between the main frame portion and loading bar for receipt of the headband 5 of the mop swab 2 in a manner to be subsequently described.

The shorter side member 11 has a side gate 16 pivotally connected to the outer end thereof. When the side gate is lifted up as shown in phantom lines in FIG. 2, the headband 5 of the mop swab 2 may readily be slid onto or off the loading bar 12 from the open side of the mop holder. However, when the side gate is closed as shown in solid lines in FIG. 2 (and also in FIG. 1), insertion and removal of the mop swab from the side is precluded by the side gate.

Figure 3:
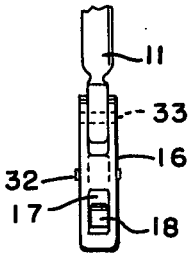
FIG. 3 is a fragmentary side elevation view of a portion of the mop holder of FIG. 2 as seen from the plane of the line 3-3 thereof.
Figure 2:
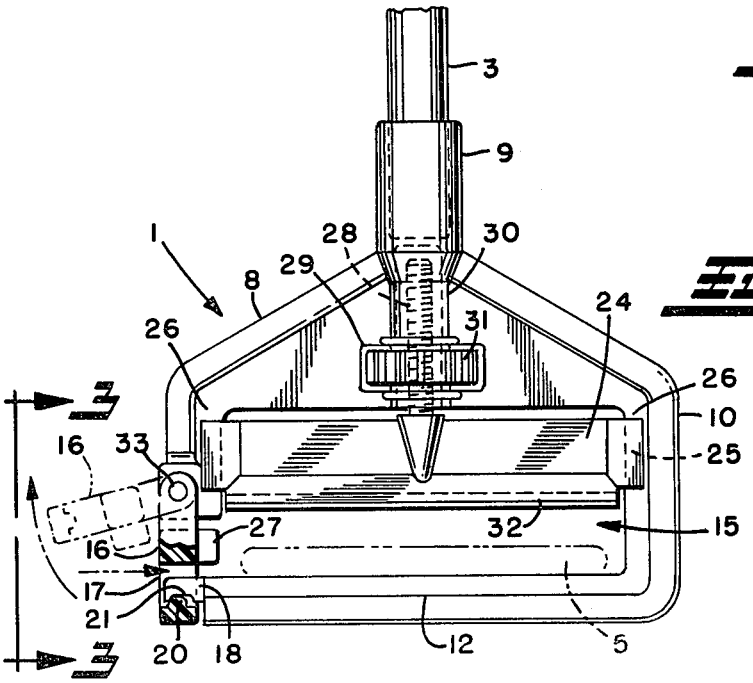
FIG. 2 is a side elevation view of the mop holder of FIG. 1, with portions of the side gate broken away to show the manner in which the free end of the loading bar is supported by the side gate when closed and the side gate is latched in the closed position.

As clearly shown in FIGS. 1 through 3, the side gate has a slot or opening 17 therethrough for receipt of the free end 18 of the loading bar when the side gate is closed to provide needed support for the free end of the loading bar especially when the swab is clamped against the loading bar as described hereafter. Moreover, as best seen in FIG. 2, a rib 20 is desirably provided on the bottom wall of the slot 17 in the side gate which is engaged by a hook 21 on the free end of the loading bar when the side gate is closed and the headband is securely clamped to the loading bar to provide a positive latch between the side gate and loading bar preventing opening of the side gate until the clamping force on the headband is released.

For clamping of the headband against the loading bar, a clamping bar 24 is provided in the open area 15 between the main frame portion 8 and loading bar 12. The clamping bar desirably extends the full width of the open area and has slots or grooves 25 along opposite ends thereof which engage guideways 26 on the side members as well as a guideway 27 on the side gate when closed for guiding the clamping member during its movement toward and away from the loading bar. To effect such movement, a threaded shaft 28 having one end fixed to the center of the clamping bar 24 extends upwardly therefrom through a slot 29 in the main frame portion and into a well or socket 30 in such main frame portion. Within the slot 29 is a thumb wheel 31 having threaded engagement with the clamping bar shaft 28. The thumb wheel is precluded from axial movement by the end walls of the slot. Accordingly, turning the thumb wheel in opposite directions will cause the clamping bar to move axially toward or away from the loading bar.

When the clamping bar 24 is fully retracted as shown in FIG. 2, there should be sufficient clearance between the clamping bar and loading bar 12 to accomodate mop swabs having headbands of different thicknesses. Also, the side gate 16 when open should provide a sufficiently large access opening to the loading bar from the side of the main frame portion to permit unobstructed insertion and removal of the mop swab therefrom. Likewise, the respective lengths of the loading bar and clamping bar should be sufficient to support and fully clamp mop swabs having a relatively wide range of widths, from relatively narrow to quite wide.

With the clamping bar retracted and the side gate open as shown in phantom lines in FIG. 2, the ends of the clamping bar will of course only be guided by the guideways 26 on the side members 10, 11 and not by the guideway 27 on the side gate itself. Moreover, even when the side gate is closed and the clamping member is moved toward the loading bar to clamp the headband thereagainst, the length of the end grooves 25 in the clamping bar are desirably such that the guideway on the shorter side member 11 will still be engaged by a portion of the groove on the adjacent end of the clamping bar while a substantial portion of the length of such groove is supported by the guideway 27 on the side gate. The lower clamping face 32 on the clamping bar is also desirably wider than the loading bar and substantially concave to provide increased surface contact with the mop head.

After the headband has been securely clamped in place, not only is it impossible to remove the swab from the mop holder, but the clamping force acting on the side gate through the loading bar will preclude the side gate from being opened because of the interengagement of the hook 21 and rib 20 until such clamping force is released. The loading bar is somewhat flexible, whereby the hook is pressed firmly into locking engagement with the rib as long as such clamping force is present.

After the swab has become sufficiently soiled, the swab may readily be removed from the holder for laundering or replacement simply by turning the thumb wheel 31 in the opposite direction to release both the clamping force on the mop head 5 and the locking force between the loading bar and side gate. Thereupon the side gate may readily be swung to the open position at which time the soiled mop swab is free to fall from the mop holder without having to touch the mop swab.

Although the mop holder can be made out of various materials, such mop holder is preferably injection molded out of a suitable plastic material to provide a relatively light weight, sturdy device which is also non-corrosive to both water and harsh cleaning chemicals and the like. Also, the loading bar 12 as well as the socket 9 for the mop handle and recess 30 for the threaded shaft on the clamping bar are desirably molded as an integral part of the main frame portion. The clamping bar 24 and thumb wheel 31 are separately molded, as is the side gate 16, but the threaded shaft 28 is preferably molded as an integral part of the clamping bar. Even the pin 33 that is used to hinge the side gate to the main frame portion is desirably made of plastic, whereby there is no possibility that the mop holder will ever rust shut. Also, there are no detachable components to lose, and there are no protruding pieces on the mop holder to accidentally mark floors.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A wet mop holder comprising a main frame portion having a pair of laterally spaced apart side members, a loading bar rigidly cantilevered at one end to one of said side members and extending transverse relative to said main frame portion and spaced therefrom to provide an opening therebetween for receipt of the head of a mop swab, and side gate means pivotally connected to the other side member for movement between an open position permitting unobstructed insertion of a mop head into said opening from the side of said main frame portion and removal therefrom, and a closed position precluding such insertion and removal, the combined length of said other side member and side gate means being substantially equal to the length of said one side member, said side gate means having means thereon for supporting the free end of said loading bar when said gate means is in such closed position, a clamping bar, means for moving said clamping bar toward and away from said loading bar for releasably clamping a mop head against said loading bar, and guide means for guiding said clamping bar during such movement toward and away from said loading bar, said guide means comprising guideways on said side members, and grooves in the ends of said clamping bar having sliding engagement with said guideways, and another guideway on said side gate means engageable by the groove in one end of said clamping bar when said side gate means is in the closed position for assisting in guiding said clamping bar during such movement toward and away from said loading bar.

2. The mop holder of claim 1 wherein the relative lengths of said side gate means and said groove in said one end of said clamping bar are such that said groove in said one end of said clamping bar will engage both said guideways on said other side member and said side gate means when said side gate means is in the closed position and said clamping bar is moved toward said loading bar to clamp a mop head thereagainst.

3. The mop holder of claim 2 wherein said clamping bar has a clamping face which is wider than said loading bar and is substantially concave to provide increased surface contact with a mop head supported on said loading bar.

4. The mop holder of claim 1 wherein said side gate means has an opening extending therethrough for receipt of the free end of said loading bar when said side gate means is in such closed position to provide support for said free end.

5. The mop holder of claim 4 further comprising latching means for releasably latching said side gate means in such closed position.

6. The mop holder of claim 5 wherein said latching means comprises a rib on the bottom wall of said opening through said side gate means, and a hook on said free end of said loading bar engageable with said rib when said side gate means is in such closed position.

7. The mop holder of claim 1 wherein said means for moving said clamping bar comprises a screw shaft fixed to said clamping bar and extending into a well in said main frame portion, a thumb wheel having threaded engagement with said screw shaft, and mounting means for mounting said thumb wheel against axial movement relative to said main frame portion, whereby turning of said thumb wheel in opposite directions will cause said clamping bar to move axially toward and away from said loading bar.

8. The mop holder of claim 7 wherein said mounting means comprises a slot in said main frame portion for receipt of said thumb wheel, said screw shaft extending through said slot, and said slot having end walls precluding axial movement of said thumb wheel during turning movement thereof.

9. The mop holder of claim 7 wherein said main frame portion and loading bar are integrally molded out of plastic, said clamping bar and screw shaft are also integrally molded out of plastic, and said side gate means and thumb wheel are separately molded out of plastic.

10. The mop holder of claim 9 further comprising a socket portion integrally molded with said main frame portion for receipt of one end of a mop handle.

* * * * *